US009073714B2

(12) United States Patent
Kim

(10) Patent No.: US 9,073,714 B2
(45) Date of Patent: Jul. 7, 2015

(54) IMAGE FORMING APPARATUS WITH A MULTI-FEEDING PREVENTION MEMBER

(71) Applicant: SAMSUNG Electronics Co., Ltd., Suwon-si, Gyeonggi-do (KR)

(72) Inventor: Hyun Woo Kim, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 65 days.

(21) Appl. No.: 13/705,255

(22) Filed: Dec. 5, 2012

(65) Prior Publication Data

US 2013/0142561 A1 Jun. 6, 2013

(30) Foreign Application Priority Data

Dec. 5, 2011 (KR) ..... 10-2011-0129081

(51) Int. Cl.
*B65H 3/06* (2006.01)
*B65H 3/52* (2006.01)
*B65H 3/56* (2006.01)

(52) U.S. Cl.
CPC ..... *B65H 3/0607* (2013.01); *B65H 3/0684* (2013.01); *B65H 3/5223* (2013.01); *B65H 3/56* (2013.01); *B65H 2301/3122* (2013.01); *B65H 2404/5214* (2013.01); *B65H 2405/3322* (2013.01); *B65H 2601/523* (2013.01)

(58) Field of Classification Search
CPC ..... B65H 3/0607
USPC ..... 271/167, 121, 124
See application file for complete search history.

(56) References Cited

U.S. PATENT DOCUMENTS

| | | | | |
|---|---|---|---|---|
| 5,443,251 | A * | 8/1995 | Kan et al. | 271/16 |
| 2004/0145719 | A1* | 7/2004 | Kawai et al. | 355/407 |
| 2008/0317534 | A1* | 12/2008 | Taki et al. | 399/405 |
| 2009/0014945 | A1* | 1/2009 | Izumichi et al. | 271/119 |
| 2011/0156340 | A1* | 6/2011 | Otsuki | 271/10.09 |
| 2012/0126475 | A1* | 5/2012 | Shin et al. | 271/117 |

FOREIGN PATENT DOCUMENTS

| | | | | |
|---|---|---|---|---|
| JP | 59048342 | A * | 3/1984 | B65H 3/46 |
| JP | 09286526 | A * | 11/1997 | B65H 1/14 |
| JP | 2002-226073 | | 8/2002 | |
| JP | 2008-127118 | | 6/2008 | |

* cited by examiner

*Primary Examiner* — Daniel J Colilla
(74) *Attorney, Agent, or Firm* — Staas & Halsey LLP

(57) ABSTRACT

An image forming apparatus includes a pick-up unit configured to pick up a printing medium stored in a printing medium storage unit and transport the picked printing medium to a printing medium transportation path provided inside a body, the pick-up unit having a pick-up roller to pick up the printing medium in the printing medium storage unit and a forward roller to guide the picked-up printing medium, to the printing medium transportation path, and the body including a guide portion slantingly extending from a lower side of the forward roller toward one side of the forward roller to guide the picked-up printing medium, and a plurality of locking protrusions protruding from the guide portion to prevent a plurality of printing media from being simultaneously entered to a gap between the forward roller and the guide portion.

24 Claims, 5 Drawing Sheets

IMAGE FORMING APPARATUS WITH A MULTI-FEEDING PREVENTION MEMBER

CROSS-REFERENCE TO RELATED APPLICATIONS

This application claims priority under 35 U.S.C. §119 from Korean Patent Applications No. 2011-0129081, filed on Dec. 5, 2011 in the Korean Intellectual Property Office, the disclosure of which is incorporated herein by reference in its entirety.

BACKGROUND OF THE INVENTION

1. Field of the Invention

Embodiments of the present disclosure relate to an image forming apparatus having a pick-up unit configured to pick up a printing medium in a printing medium storage unit.

2. Description of the Related Art

An image forming apparatus is an apparatus designed to form an image on a printing medium, and includes a printer, a copy machine, a facsimile, and a multifunctional device incorporating the functionalities of the printer, the copy machine, and the facsimile.

An image forming apparatus includes a body provided at an inner side thereof with a printing medium transportation path through which a printing medium is transported, a printing medium storage unit disposed at a lower side of the body and configured to store printing media, a developing unit configured to develop an electrostatic latent image to a visible image through developer and to transfer the visible image to the printing medium, an exposure unit enabling an electrostatic latent image to be formed on a photoconductor of the developing unit, and a fixing unit to fix the developer transferred to the printing medium.

The image forming apparatus includes a pick-up unit to pick up the printing media, which are stored in the printing medium storage unit, one by one, and to transport the picked printing medium to a printing medium transportation path. The pick-up unit includes a pick-up roller having a pick-up portion protruding at an outer circumferential surface thereof. According to the rotation of the pick-up roller, the pick-up portion makes contact with the printing medium stored in the printing medium storage unit, so that the printing medium is picked up and transported.

In the case of the pick-up roller having the above-described structure, in order to increase the distance of the printing medium being transported by the pick-up roller, the diameter of the pick-up roller needs to be increased. If the diameter of the pick-up roller is increased, the height of the body also needs to be increased to correspond to the increased diameter.

SUMMARY OF THE INVENTION

The present disclosure provides an image forming apparatus having a housing with a pickup unit to transport a printing medium and reducing a height of the housing thereof.

Additional features and utilities of the present general inventive concept will be set forth in part in the description which follows and, in part, will be obvious from the description, or may be learned by practice of the disclosure.

The foregoing features and utilities of the present general inventive concept may be achieved by providing an image forming apparatus includes a body, a printing medium storage unit, and a pick-up unit. The body may be provided at an inner side thereof with a printing medium transportation path, along which a printing medium is transported. The printing medium storage unit may be disposed at a lower portion of the body and configured to store the printing medium. The pick-up unit may be disposed at one side of a upper portion of the printing medium storage unit and configured to pick up the printing medium in the printing medium storage unit and to transport the picked printing medium to the printing medium transportation path. The pick-up unit may include a pick-up roller to pick up the printing medium in the printing medium storage unit and a forward roller to guide the printing medium, which is picked by the pick-up roller, to the printing medium transportation path. The body may include a guide portion slantingly extending from a lower side of the forward roller toward one side of the forward roller so as to guide the printing medium picked by the pick-up roller, and a plurality of locking protrusions protruding from the guide portion to prevent a plurality of printing media from being simultaneously entered to a gap between the forward roller and the guide portion.

The plurality of locking protrusions may be provided at both sides of the guide portion while in symmetric to each other about the forward roller.

The body may include a loading portion provided at an upper portion of the body such that the printing medium, having completed with image forming, is loaded on the loading portion, and a discharge hole provided at a side of the loading portion to discharge the printing medium having completed with image forming. The printing medium transportation path may be provided in a C shape that is directed from the printing medium storage unit to the discharge hole.

The image forming apparatus may further include a multi-feeding prevention member which is disposed opposite the forward roller to prevent a plurality of printing media from being simultaneously entered to the printing medium transportation path.

The guide portion may be provided with a through-hole formed at a position corresponding to the forward roller, and the multi-feeding prevention member may include a friction pad that is rotatably installed at the through-hole.

The image forming apparatus may further include an elastic member that allows the friction pad to be elastically supported by an outer surface of the forward roller.

The multi-feeding prevention member may include a retard roller that is disposed opposite the forward roller.

The plurality of locking protrusions may be formed at a lower lateral side of the multi-feeding prevention member.

The locking protrusion may be provided at a position lower than a position of the forward roller, and a difference in height between a lower surface of the forward roller and an upper end of the locking protrusion may be equal to or less than 4 mm.

The printing medium that is loaded in the printing medium storage unit at a maximum loading capacity may have a height higher than a height of a lower end of the friction pad.

A gap between a lateral side end of the locking protrusion and a lateral side end of the friction pad is about 0 mm or above, and 30 mm or below.

The foregoing features and utilities of the present general inventive concept may also be achieved by providing an image forming apparatus include a body, a printing medium storage unit, and a pick-up unit. The body may be provided at an inner side thereof with a printing medium transportation path, along which a printing medium is transported. The printing medium storage unit may be disposed at a lower side of the body and configured to store the printing medium. The pick-up unit may be disposed at one side of an upper portion of the printing medium storage unit and configured to pick up the printing medium in the printing medium storage unit and to transport the picked printing medium to the printing medium transportation path. The body may include a loading portion provided at an upper portion of the body such that the printing medium, having completed with image forming, is loaded on the loading portion, and a discharge hole provided at one side of the loading portion to discharge the printing medium having completed with image forming. The printing medium transportation path is provided in a C-shape that is directed from the printing medium storage unit to the discharge hole. The pick-up unit may include a pick-up roller to pick up the printing medium in the printing medium storage unit, and a forward roller to guide the printing medium, which is picked by the pick-up roller, to the printing medium transportation path.

Since a guide portion configured to guide the printing medium has a locking protrusion protruding therefrom, a printing medium positioned at a lower side among the plurality of printing media is locked or blocked by the locking protrusion when the printing media are picked up by the pick-up roller, and if a plurality of printing media are simultaneously picked up and transported, thereby preventing the plurality of printing media from being entered to a gap between a forward roller and a guide roller.

In addition, since the pick-up unit includes a pick-up roller and a forward roller, the printing medium is transported by a sufficient distance through the pick-up roller and the forward roller, both of which have a small diameter, even in an image forming apparatus having a C-shaped printing medium transportation path.

The foregoing features and utilities of the present general inventive concept may also be achieved by providing an image forming apparatus including a printing medium storage unit configured to store printing media, a pick-up unit having a pick-up roller to pick up the print media and a forward roller disposed to transport the picked-up printing media, and a guide portion disposed to correspond to the forward roller and having one or more protrusions disposed to prevent a first multiple pick-up of the picked-up printing media received from the pick-up roller, and a friction pad disposed to prevent a second multiple pick-up of the picked-up printing media which have passed through the protrusions.

A first number of the printing media P picked-up by the pick-up roller may be blocked by the protrusions, and a second number of the printing media P passing through the protrusions may be blocked by the friction pad.

The guide portion may include a surface having one or more sub-protrusions to guide the picked-up printing medium, and the one or more protrusions may be higher than the one or more sub-protrusions.

The one or more protrusions may be disposed adjacent to the friction pad and are disposed opposite to each other with respect to the forward roller such that a center portion of the picked-up printing medium is lifted up toward the forward roller higher than other portions of the picked-up printing medium supported by the sub-protrusions.

The pick-up roller and the forward roller may rotate according to a rotation force, and the pick-up roller and the forward roller may be disposed to be biased toward the printing media stored in the printing medium storage unit according to the rotation thereof.

The pick-up roller and the forward roller may rotate more than two times to perform picking-up and transporting operations.

The image forming apparatus may further include a plurality rollers disposed in an image forming area and a discharging area, and the pick-up roller and the forward roller may have a diameter smaller than the plurality of rollers.

The pick-up roller and the forward roller may be disposed on a plane substantially parallel to the printing medium stored in the printing medium storage unit.

BRIEF DESCRIPTION OF THE DRAWINGS

These and/or other features and utilities of the present general inventive concept e will become apparent and more readily appreciated from the following description of the embodiments, taken in conjunction with the accompanying drawings of which.

DETAILED DESCRIPTION OF THE PREFERRED EMBODIMENTS

Figure 1:
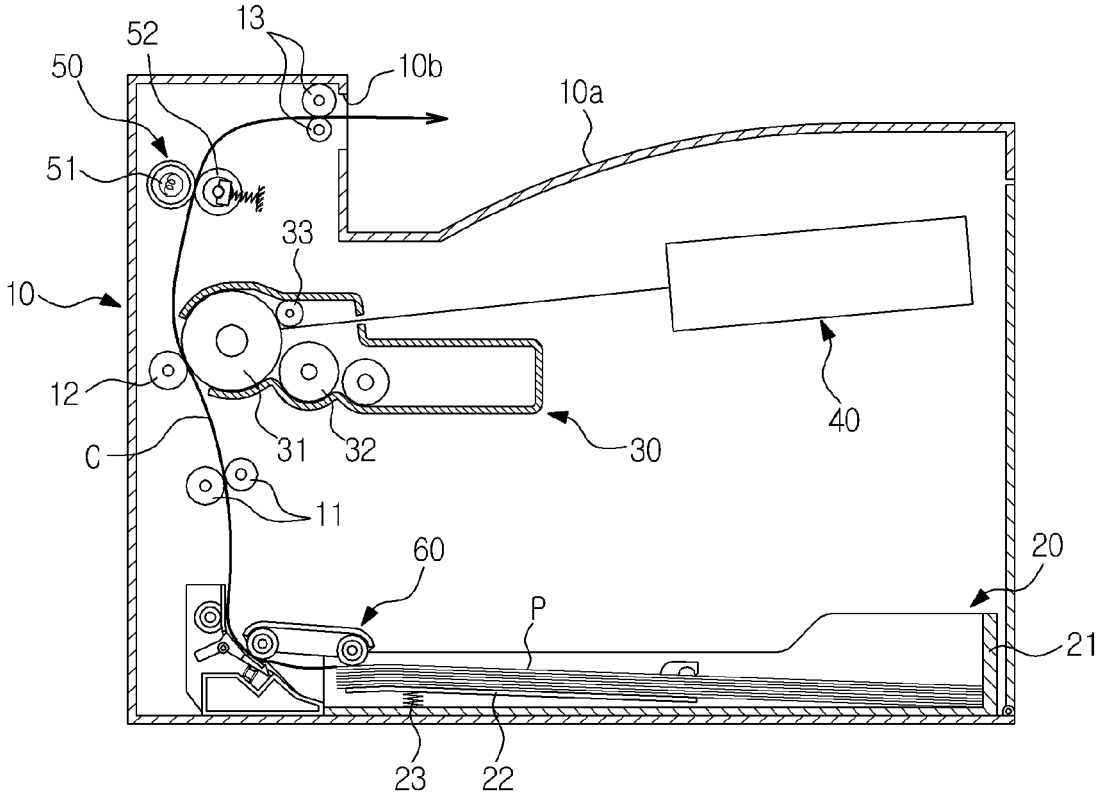
FIG. 1 is a view schematically illustrating an image forming apparatus according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures.

Referring to FIG. 1, an image forming apparatus according to an embodiment of the present general inventive concept includes a body 10 (or housing) to form an external appearance of the image forming apparatus, a printing medium storage unit 20 to store a printing medium P, a developing unit 30 to supply an electrostatic latent image with a developer such that the electrostatic latent image is developed to a visible image, an exposure unit 40 to form an electrostatic latent image on a photoconductor 31 of the developing unit 30 that is charged with an electric potential, and a fixing unit 50 to fix the developer developed on the printing medium P to the printing medium P to form an image thereon.

The body 10 has a discharging portion 10*a* formed at an upper side thereof so as to receive the discharged printing medium P with the formed image thereon, and a discharge hole 10*b* formed at a side of the discharging portion 10*a* to discharge the printing medium P with the formed image.

The printing medium storage unit 20 includes a printing medium cassette 21 reciprocatingly installed on the body 10, a knock-up plate 22 disposed in the printing medium cassette 21 to allow the printing medium P to be loaded thereon, and a knock-up spring 23 elastically supporting a side of the knock-up plate 22.

The developing unit 30 includes the photoconductor 31, which includes an image carrier to be formed with an electrostatic latent image by the exposure unit 40 and to carry a visible image formed by a developer, a developing roller 32 to supply the photoconductor 31 with the developer such that the electrostatic latent image of the photoconductor 31 is developed to the visible image by the developer, and a charge roller 33 to charge the surface of the photoconductor 31.

The exposure unit 40 exposes the light that includes image information to the photoconductor 31 provided on the developing unit 30, thereby forming the electrostatic latent image on the photoconductor 31.

The fixing unit 50 includes a heating roller 51 to generate heat and a pressure roller 52 having an outer surface that is formed by using an elastic deformable material to press the printing medium P against an outer surface of the heating roller 51.

The image forming apparatus may include a pick-up unit 60, a pair of feeding rollers 11, a transfer roller 12 and a pair or discharge rollers 13 which are disposed in an inner side of the body 10. The pick-up unit 60 is disposed at an upper portion of the printing medium storage unit 20 to pick up the printing medium P loaded on the knock-up plate 22 one by one. The pair of feeding rollers 11 is disposed at an upper side of the pick-up unit 60 to guide the printing medium P, which is picked up by the pick-up unit 60, to the developing unit 30 that is provided at an upper side of the feeding roller 11. The transfer roller 12 is disposed opposite the photoconductor 31 to transfer the developer on the photoconductor 31 to the printing medium P. The pair of discharge rollers 13 are disposed at a upper side of the fixing unit 50 while being adjacent to the discharge hole 10*b* such that the printing medium P passing through the fixing unit 50 is discharged through the discharge hole 10*b*.

The image forming apparatus may have a printing medium transportation path C having a C shape which is provided to guide the printing medium P from the printing medium storage unit 20 to the discharge hole 10*b*. The C shape of the printing medium transportation path C may include a first portion (first direction) to pick up the printing medium P from the printing medium cassette 21, a second portion (second direction) connected to the first portion to feed the picked up printing medium P to pass through an image forming area in a direction (or an upward direction), and a third portion (third direction) connected to the second portion to discharge the printing medium P with an image formed in the image forming area toward the discharging portion. The developing unit 30 may be disposed in a space provided inside of the C shape or may be surrounded by the first, second, and third portions of the C shape. The printing medium transportation path C is usable for a small image forming apparatus. The small image forming apparatus may use only a black developer. However, the present general inventive concept is not limited thereto. The small image forming apparatus may use more than two developers. Accordingly, the printing medium P that is picked up from the printing medium storage unit 20 through the pick-up unit 60, after sequentially passing through the developing unit 30 and the fixing unit 50 along the printing medium transportation path C having the C shape, is discharged through the discharge hole 10*b* to the loading portion 10*a*.

Figure 2:
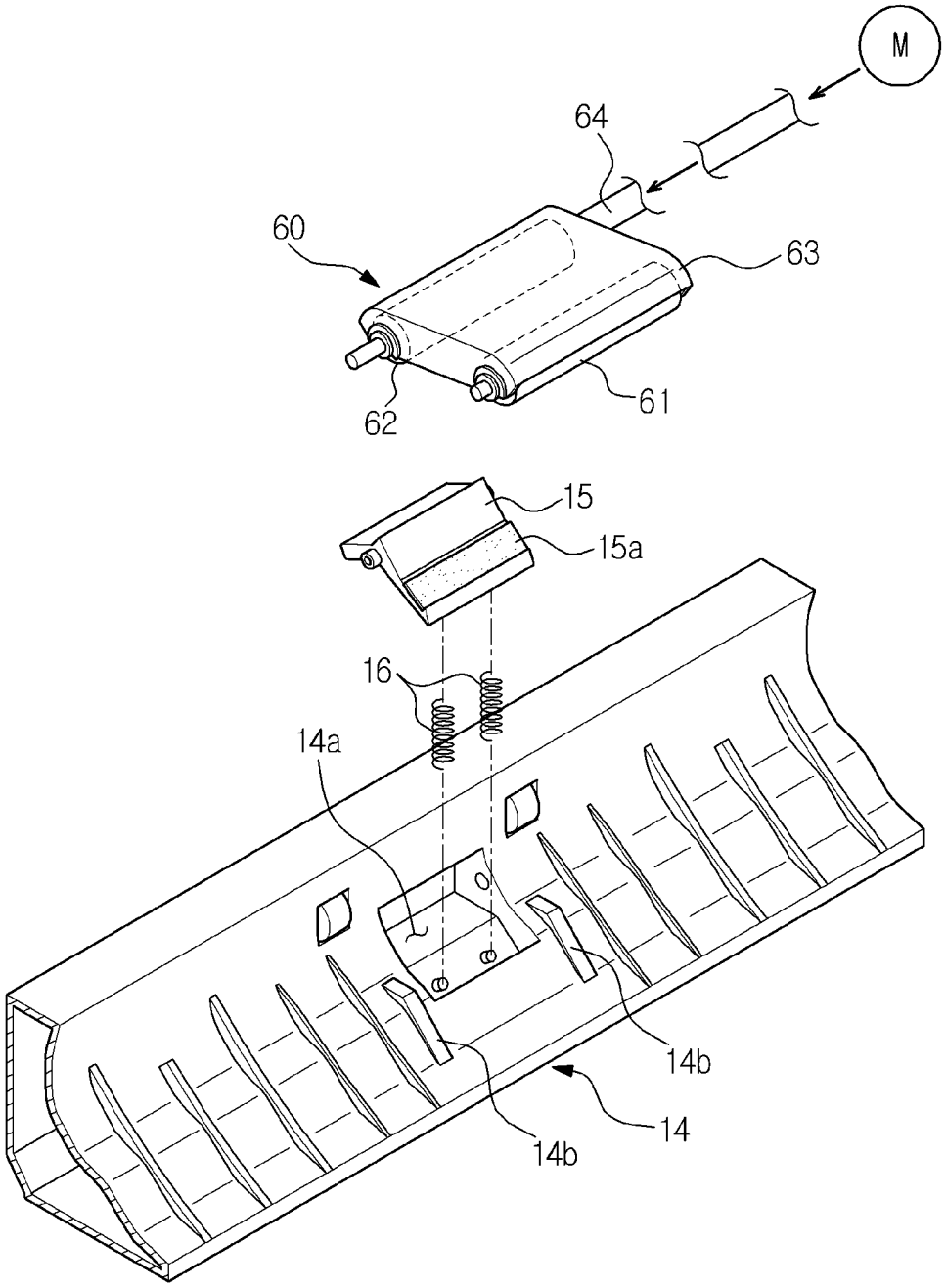
FIG. 2 is a perspective view illustrating an installation state of a pick-up unit applied to the image forming apparatus of FIG. 1.
Figure 3:
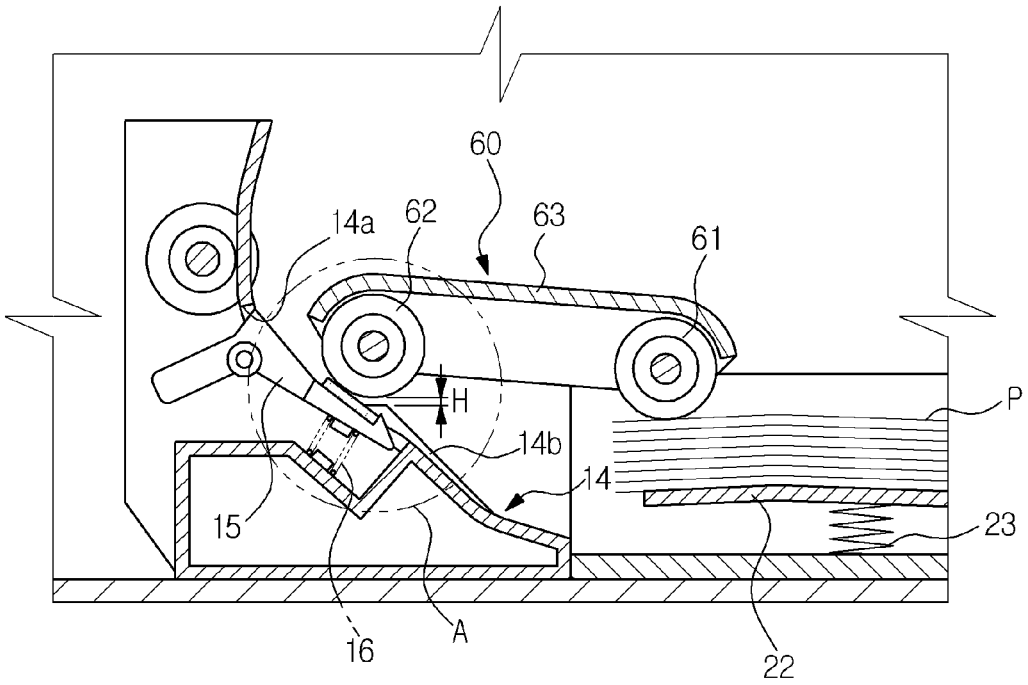
FIG. 3 is a cross-sectional view illustrating an installation state of a pick-up unit applied to the image forming apparatus of FIG. 1.

Referring to FIGS. 2 and 3, the pick-up unit 60 includes a pick-up roller 61 to pick up the printing medium P one by one while making contact with the printing medium P on the knock-up plate 22, a forward roller 62 to receive the printing medium P picked by the pick-up roller 61 and move the received printing medium P toward the feeding roller 11, a pick-up housing 63 installed to be rotatable with respect to the forward roller 62 in the body 10 and installed to support the pick-up roller 61 and the forward roller 62 to rotate, and a power transmission shaft 64 to transmit a rotating force of a rotating power source M to the pick-up unit 60.

The pick-up unit 60 may rotate with respect to a rotation axis of a shaft of the forward roller 62, and thus when the pick-up roller 61 and the forward roller 62 rotate in a direction to pick-up and transport a printing medium according to the rotation force transmitted through the power transmission shaft 64, the housing 63 may rotate in the direction with respect to the forward roller 62 so that the pick-up roller 61 and the forward roller 62 can be biased toward the printing medium loaded on the knock-up plate 220 of the printing medium cassette 21.

According to the above described configuration in which the pick-up unit 60 includes the pick-up roller 61 and the forward roller 62, the printing medium P is transported at a sufficient distance to pick up the printing medium P and to feed the picked up printing medium from the first portion to the second portion of the printing medium transportation path C even if both the pick-up roller 61 and the forward roller 62 have a small diameter, so that a height of the pick-up unit 60 is reduced with respect to a reference surface, for example, the print medium cassette 21, the knock-up plate 23, or a bottom of the body 10. The pick-up roller 61 and the forward roller 62 may have a reduced diameter such the height of the body 10 is also reduced. Accordingly, the body 10 is configured with a compact structure.

The pick-up roller 61 and the forward roller 62 may have the smaller diameter to pick up or feed the printing medium P according to a plurality of rotations according to the rotation force. For example, a pick-up roller with a large diameter may rotate one or two times to perform a pick up operation. However, the pick-up roller 61 may rotate more than two times to perform a pick-up operation on the printing medium P, and the forward roller 62 may rotate more than two times to perform a feeding operation (or second pick-up operation) on the picked-up printing medium P.

The pick-up roller 61 and the forward roller 62 may have a diameter smaller than other rollers in an image forming area and a printing medium discharging area along the printing medium transportation path C.

Since the pick-up roller 61 rotates with respect to an axis of the housing 63 or a rotation axis of the forward roller 62 to be biased toward the printing medium P, and the pick-up roller 61 and the forward roller 62 are disposed to rotate within the housing 63, an operation of the pick-up roller 61 may be referred to as a first pick-up operation, and an operation of the forward roller 62 may be referred to as a second pick-up operation.

The pick-up roller 61 and the forward roller 62 may have rotation axes disposed on a plane substantially parallel to a direction of the surface of the printing medium P stored in the printing medium cassette 21. The plane and the direction may be disposed in a linear direction. It is possible that the pick-up roller 61 and the forward roller 62 may have rotation axes disposed on a plane having a small angle, for example, an angle smaller than about 30 degrees, with the surface of the printing medium P stored in the printing medium cassette 21.

The image forming apparatus may have a guide portion 14 provided at one side of the printing medium storage unit 20 at a low side of the body 10 to guide such that the printing medium P that is picked up by the pick-up unit 60 is entered or fed to the printing medium transportation path C. The guide portion 14 slantingly extends from the lower side of the forward roller 62 to one side of the forward roller 62, such that the printing medium P picked up by the pick-up roller 61 is entered or fed to the printing medium transportation path C by passing through a gap between the guide portion 14 and the forward roller 62.

During a process of picking up the printing medium P in the image forming apparatus, a plurality of printing media may be simultaneously picked up due to static electricity, for example, and may be entered into the printing medium transportation path C. In this case, one or more printing media may be jammed in the printing medium transportation path C.

In order to prevent the printing medium from being jammed, the guide portion 14 has a through-hole (or recess portion) 14*a* formed at a position corresponding to the forward roller 62. In addition, a multi-feeding prevention member is installed on the through-hole 14*a* and is disposed opposite to the forward roller 62 with respect to a path of the printing medium P to prevent a plurality of printing media from being simultaneously entered into the printing medium transportation path C. According to the embodiment, the multi-feeding prevention member may include a friction element 15 having a friction pad a disposed on a surface of the friction element 15. The friction element 15 has a portion rotatably or movably installed in the recess portion 14*a*, and the surface of the friction pad 15*a* is disposed to face the forward roller 62 having a greater coefficient of friction, so that the one or more printing media P are locked (blocked) or prevented from being entered or fed to the printing medium transportation path C, except one printing medium P. The friction element 15 is elastically supported by a pad spring 16, and thus the friction pad 15*a* can be supported by or biased toward an outer circumferential surface of the forward roller 62. Accordingly, when a plurality of printing media P pass through a gap between the forward roller 62 and the friction pad 15*a*, one or more printing media disposed at a lower side among the plurality of printing media P is locked (blocked) or prevented from being transferred by the friction pad 15*a*, so that the one or more blocked or prevented printing media fails to enter into the printing medium transportation path C.

In addition, the image forming apparatus employed is configured to have a body with a compact structure. Accordingly, when the printing media P are loaded on the knock-up plate 22 with a maximum loading capacity, a height of an upper end of the printing media P loaded on the knock-up plate 22 may be higher than a lower end of the friction pad 15*a*. If the printing media P are picked up by the pick-up unit 60 at this state, a front end (or leading edge) of the printing media P that are picked up is directly moved toward the friction pad 15*a* without being guided by the guide portion 14. In this case, the front end of the printing media P applies a force to the friction pad 15 while being temporarily supported by the friction pad 15.

When the front end of the printing medium P applies a force to the friction element 15 while being directly supported by the friction pad 15*a*, it is possible that the force may not cause drawbacks when about two sheets of printing media P are supported by the friction pad 15*a*. However, when two or more sheets of printing media P are simultaneously transported, the friction element 15 is pushed by the front ends of the transported printing media P, so that the friction pad 15*a* may cause the plurality of printing media P to be simultaneously entered into the printing medium transportation path C.

Accordingly, the guide portion 14 is provided with a plurality of locking protrusions 14*b* to prevent the plurality of printing media P from being simultaneously entered to a gap between the forward roller 62 and the guide portion 14. The locking protrusion 14*b* has an upper end at a position lower than the forward roller 62 while being provided at a lower lateral side of the friction pad 15*a* that represents the multi-feeding prevention member. According to an experiment, when the difference in height between the lower surface of the forward roller 62 and the upper end of the locking protrusion 14*b* was equal to or less than 4 mm, the friction pad 15*a* is hardly pushed by the printing media P. In addition, according to the embodiment, the plurality of locking protrusions 14*b* are provided at both sides of the guide portion 14. The locking protrusions 14*b* are disposed in symmetric to each other about the forward roller 62, so that both sides of the printing media P are simultaneously locked (blocked) or prevented from being fed.

Figure 5:
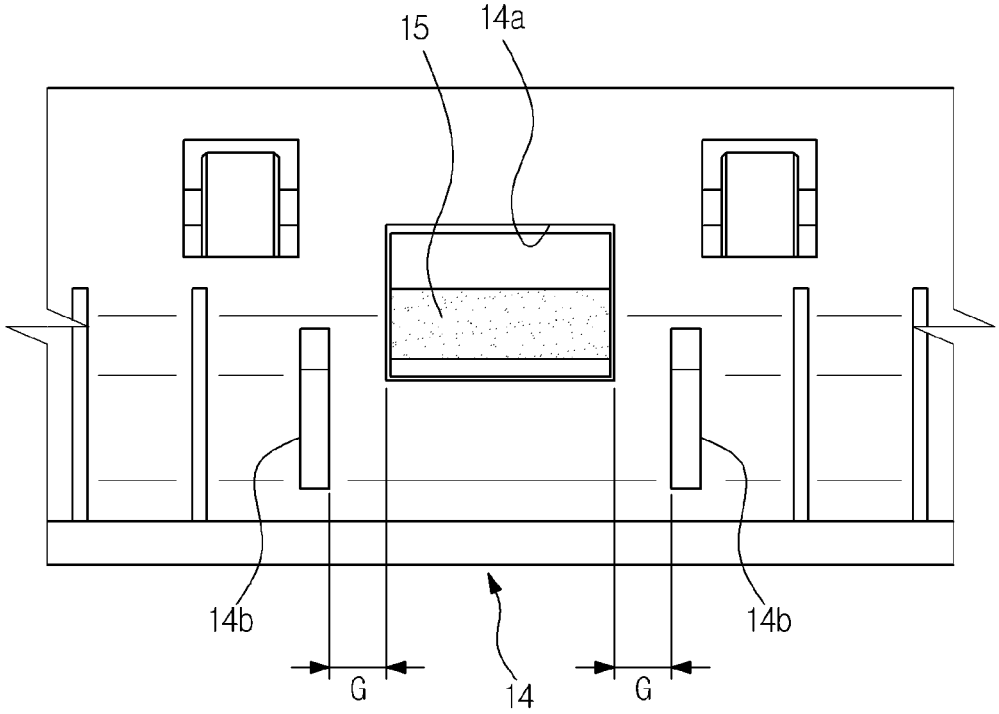
FIG. 5 is a view illustrating a guide portion and a friction pad that are applied to the image forming apparatus of FIG. 1.

In addition, the printing medium P transported by the pick-up roller 61 moves while being supplied with a force from the pick-up roller 61 at a center portion of the printing medium P. In this case, both end portions (leading and trailing edge portions) of the printing medium P may droop due to a weight thereof. Accordingly, two units of locking protrusions 14*b* are formed while being disposed far apart from the friction pad 15*a*, the both end portions of the printing medium P may be unnecessarily locked (blocked) or prevented by the two locking protrusions 14*b*. Accordingly, the two locking protrusions 14*b* are disposed adjacent to the friction pad 15*a*. According to the result of the experiment, as illustrated in FIG. 5, a gap between a lateral side end of each locking protrusion 14*b* and a lateral side end of the friction pad 15 was 0 mm or above, and 30 mm or below.

Figure 4:
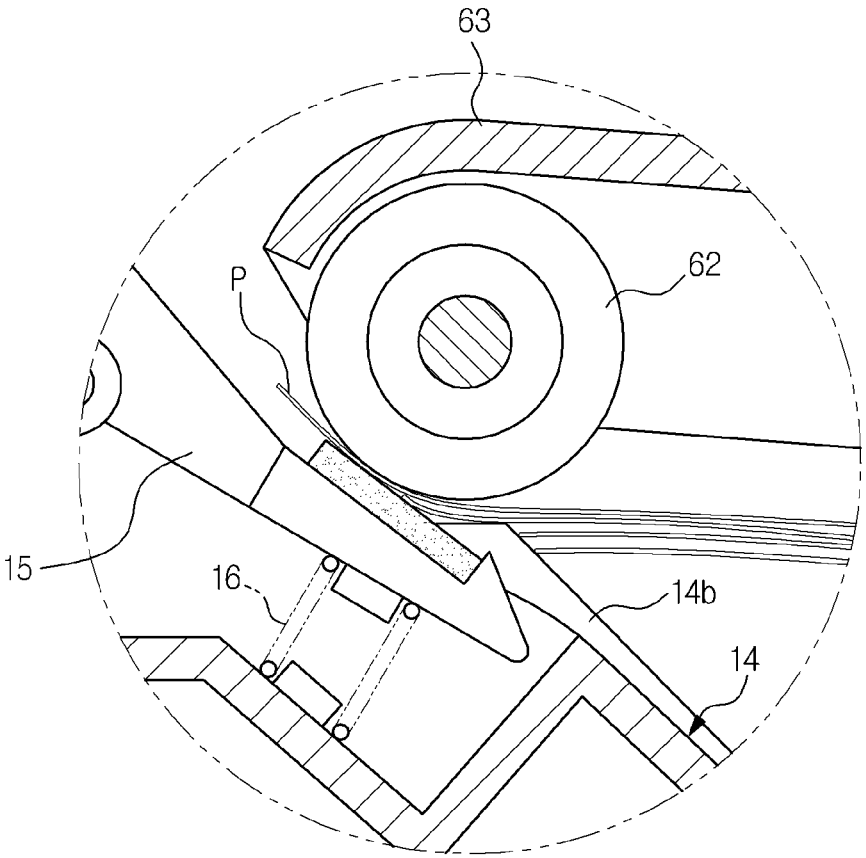
FIG. 4 is an enlarged view of 'A' portion of FIG. 3.

By forming the locking protrusion 14*b* on the guide portion 14 as illustrated in FIG. 4, even if the plurality of printing media P are picked up from the printing medium storage unit 20 and transferred, most of the printing media P (or a first number of the printing media P) are locked (blocked) by the locking protrusion 14*b*, and thus are prevented from being transported. Only two or three sheets of the printing media P (or a second number of the printing media P) are supported at the front ends thereof by the friction pad 15*a*. Two or three sheets of the printing media P (or second number of the printing media P) may not cause the friction pad 15*a* to be pushed. Accordingly, the friction pada 15 enables one sheet of the printing medium to be entered to the printing medium transportation path C while preventing a plurality of printing media P (a third number of printing media P) from being entered into the printing media transportation path C.

The protrusions 14*b* of the guide portion 14 may be referred to as a first multiple pick-up preventing structure to perform a first multiple pick-up preventing operation on the picked-up printing media P received from the pick-up roller 61, and the friction pad 15*a* of the friction element 15 may be referred to as a second multiple pick-up preventing structure to perform a second multiple pick-up preventing operation on the picked-up printing media P which passed the protrusions 14*a*.

The multi-feeding prevention member according to the embodiment has the friction pad 15*a*, which is configured to prevent a plurality of printing media from being simultaneously moved to the printing medium transportation path C, disposed opposite to each other with respect to the forward roller 62. However, the present general inventive concept is not limited thereto, and may have a retard roller (not illustrated), which is configured to transport the printing media P fed to the multi-feeding prevention member to the printing medium storage unit 20, disposed opposite to each other with respect to the forward roller 62.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. An image forming apparatus comprising:

a body provided at an inner side thereof with a printing medium transportation path, along which a printing medium is transported;

a printing medium storage unit configured to store the printing medium; and a pick-up unit disposed at one side of an upper portion of the printing medium storage unit and configured to pick up the printing medium in the printing medium storage unit and to transport the picked-up printing medium to the printing medium transportation path, wherein the pick-up unit comprises a pick-up roller to pick up the printing medium in the printing medium storage unit and a forward roller to guide the picked-up printing medium to the printing medium transportation path and a pick-up housing to support the pick-up roller and the forward roller such that the pick-up housing rotates with respect to the forward roller to cause the pick-up roller and the forward roller to be biased toward the printing medium in the printing medium storage unit, and wherein the body comprises a guide portion slantingly extending from a lower side of the forward roller toward an upstream side of the forward roller so as to guide the picked-up printing medium, and a plurality of locking protrusions protruding from the guide portion to prevent a number of the printing media from being simultaneously entered into a gap between the forward roller and the guide portion, wherein the guide portion comprises a surface having one or more protrusions and one or more sub-protrusions to guide the picked-up printing media, and wherein the one or more protrusions are higher than the one or more sub-protrusions.

2. The image forming apparatus of claim 1, wherein the plurality of locking protrusions are provided at both sides of the guide portion to be disposed symmetrically to each other about the forward roller.

3. The image forming apparatus of claim 1, wherein the body comprises a discharging portion provided at an upper portion of the body such that the printing medium with a formed image is discharged on a loading portion, and a discharge hole provided at a side of the discharging portion to discharge the printing medium with the formed image, and wherein the printing medium transportation path is provided in a C shape that is directed from the printing medium storage unit to the discharge hole through an image forming area.

4. The image forming apparatus of claim 1, wherein the multi-feeding prevention member is disposed opposite to the forward roller.

5. The image forming apparatus of claim 4, wherein the guide portion is provided with a through-hole formed at a position corresponding to the forward roller, and wherein the multi-feeding prevention member comprises a friction pad that is rotatably installed et the through-hole.

6. The image forming apparatus of claim 5, wherein the elastic member is disposed to allow the friction pad to be elastically supported adjacent to an outer surface of the forward roller.

7. The image forming apparatus of claim 4, wherein the plurality of locking protrusions is formed at a lower lateral side of the multi-feeding prevention member.

8. The image forming apparatus of claim 4, wherein the plurality of locking protrusions is provided at a position lower than a position of the forward roller such that a difference in height between a lower surface of the forward roller and an upper end of the plurality of locking protrusions is equal to or less than 4 mm.

9. The image forming apparatus of claim 8, wherein the printing medium that is loaded in the printing medium storage unit at a maximum loading capacity has a height higher than a height of a lower end of the friction pad.

10. The image forming apparatus of claim 5, wherein a distance between a lateral side end of the locking protrusion and a lateral side end of the friction pad is about 0 mm or above, and 30 mm or below.

11. An image forming apparatus comprising:

a body provided at an inner side thereof with a printing medium transportation path, along which a printing medium is transported;

a printing medium storage unit configured to store the printing medium; and a pick-up unit disposed at one side of an upper portion of the printing medium storage unit and configured to pick up the printing medium in the printing medium storage unit and to transport the picked-up printing medium to the printing medium transportation path, wherein the body comprises a loading portion provided at an upper portion of the body such that the printing medium, having completed with image forming, is loaded on the loading portion, and a discharge hole provided at one side of the loading portion to discharge the printing medium having completed with image forming, the printing medium transportation path is provided in a C-shape that is directed from the printing medium storage unit to the discharge hole, and the pick-up unit comprises a pick-up roller to pick up the printing medium in the printing medium storage unit, and a forward roller to guide the picked-up printing medium, to the printing: medium transportation path and a pick-up housing to support the pick-up roller and the forward roller such that the pick-up housing rotates with respect to the forward roller to cause the pick-up roller and the forward roller to be biased toward the printing medium in the printing medium storage unit, wherein the body comprises a guide portion slantingly extending from a lower side of the forward roller toward an upstream side of the forward roller so as to guide the picked-up printing medium, wherein the guide portion comprises a surface having one or more protrusions and one or more sub-protrusions to guide the picked-up printing media, and wherein the one or more protrusions are higher then the one or more sub-protrusions.

12. The image forming apparatus of claim 11, wherein the body comprises a guide portion slantingly extending from a lower side of the forward roller toward an upstream side of the forward roller so as to guide the printing medium picked up by the pick-up roller, and a plurality of locking protrusions protruding from the guide portion to prevent a plurality of printing media from being simultaneously entered into a gap between the forward roller and the guide portion.

13. The image forming apparatus of claim 12, wherein the plurality of locking protrusion are provided at both sides of the guide portion to be disposed symmetrically to each other about the forward roller.

14. The image forming apparatus of claim 12, wherein the guide portion is provided with a through-hole formed at a position corresponding to the forward roller, and wherein the guide portion further comprises a friction pad that is rotatably installed at the through-hole, and an elastic member disposed to allow the friction pad to be elastically supported adjacent to an outer surface of the forward roller.

15. The image forming apparatus of claim 14, wherein the plurality of locking protrusions is formed at a lower lateral side of the friction pad.

16. The image forming apparatus of claim 14, wherein the plurality of locking protrusions is provided at a position lower than a position of the forward roller such that a difference in height between a lower surface of the forward roller and an upper end of the plurality of locking protrusions is equal to or less than 4 mm.

17. The image forming apparatus of claim 14, wherein the printing medium that is loaded in the printing medium storage unit at a maximum loading capacity has a height higher than a height of a lower end of the friction pad.

18. An image forming apparatus comprising:

a printing medium storage unit configured to store printing media;

a pick-up unit having a pick up roller to pick up the print media and a forward roller disposed to transport the picked-up printing media and a pick-up housing to support the pick-up roller and the forward roller such that the pick-up housing rotates with respect to the forward roller to cause the pick-up roller and the forward roller to be biased toward the printing media in the printing medium storage unit; and a guide portion disposed to correspond to the forward roller and having one or more protrusions disposed to prevent a first multiple pickup of the picked-up printing media received from the pick-up roller, and a friction pad disposed to prevent a second multiple pick-up of the picked-up printing media which have passed through the protrusions, wherein the guide portion comprises a surface having one or more protrusions and one or more sub-protrusions to guide the picked-up printing media, and wherein the one or more protrusions are higher than the one or more sub-protrusions.

19. The image forming apparatus of claim 18, wherein a first number of the printing media picked-up by the pick-up roller are blocked by the protrusions, and a second number of the printing media passing through the protrusions are blocked by the multi-feeding prevention member comprising a friction pad.

20. The image forming apparatus of claim 18, wherein the one or more protrusions are disposed adjacent to the friction pad and are disposed opposite to each other with respect to the forward roller such that a center portion of the picked-up printing medium is lifted up toward the forward roller higher than other portions of the picked-up printing media supported by the sub-protrusions.

21. The image forming apparatus of claim 18, wherein the pick-up roller and the forward roller rotate according to a rotation force, and the pick-up roller and the forward roller are disposed to be biased toward the printing media stored in the printing medium storage unit according to the rotation thereof.

22. The image forming apparatus of claim 18, wherein the pick-up roller rotates more than two times to perform a picking-up operation and the forward roller rotates more than two times to perform a feeding operation corresponding to the rotation of the pick-up roller.

23. The image forming apparatus of claim 18, further comprising:

a plurality of rollers disposed in an image forming area and a discharging area, wherein the pick-up roller and the forward roller have a diameter smaller than the plurality of rollers.

24. The image forming apparatus of claim 18, wherein the pick-up roller and the forward roller are disposed on a plane substantially parallel to the printing medium stored in the printing medium storage unit.

* * * * *

UNITED STATES PATENT AND TRADEMARK OFFICE

CERTIFICATE OF CORRECTION

PATENT NO. : 9,073,714 B2
APPLICATION NO. : 13/705255
DATED : July 7, 2015
INVENTOR(S) : Hyun Woo Kim It is certified that error appears in the above-identified patent and that said Letters Patent is hereby corrected as shown below:

In the claims

Claim 5, Column 9, Line 53

Delete “et” and insert --at--, therefor.

Claim 11, Column 10, Line 35 (Approximately)

Delete “printing:” and insert --printing--, therefor.

Claim 11, Column 10, Line 48

Delete “then” and insert --than--, therefor.

Signed and Sealed this
Twenty-seventh Day of October, 2015

Michelle K. Lee

Michelle K. Lee
*Director of the United States Patent and Trademark Office*